US006269531B1

(12) United States Patent
Mercado et al.

(10) Patent No.: US 6,269,531 B1
(45) Date of Patent: Aug. 7, 2001

(54) METHOD OF MAKING HIGH-CURRENT COILS

(75) Inventors: Eduardo Mercado, San Andres Atoto (MX); Louis Josephs, Moorpark, CA (US)

(73) Assignees: Electro Componentes Mexicana S.A. De C.V., Naucalpan (MX); Precision One, Moorpark, CA (US)

( * ) Notice: Subject to any disclaimer, the term of this patent is extended or adjusted under 35 U.S.C. 154(b) by 0 days.

(21) Appl. No.: 09/333,065

(22) Filed: Jun. 14, 1999

Related U.S. Application Data

(60) Provisional application No. 60/095,948, filed on Aug. 10, 1998.

(51) Int. Cl.[7] ..... H01F 7/06

(52) U.S. Cl. ..... 29/602.1; 29/605; 29/606

(58) Field of Search ..... 29/602.1, 592.1, 29/605, 596, 606; 336/45, 65, 192, 208, 223; 228/102, 103

(56) References Cited

U.S. PATENT DOCUMENTS

| | | | | |
|---|---|---|---|---|
| 4,493,138 | * | 1/1985 | Gibbs et al. | 29/33 Q |
| 4,634,911 | * | 1/1987 | Studniarz et al. | 310/215 |
| 5,099,159 | * | 3/1992 | Liptak et al. | 310/45 |

FOREIGN PATENT DOCUMENTS

| | | | | |
|---|---|---|---|---|
| 87808 | * | 5/1984 | (JP) | 29/602.1 |
| 61121308 | * | 6/1986 | (JP) . | |
| 1183177 | * | 7/1989 | (JP) | 29/599 |
| 1295643 | * | 11/1989 | (JP) . | |
| 5299274 | * | 11/1993 | (JP) | 29/602.1 |
| 6120047 | * | 4/1994 | (JP) | 29/602.1 |

* cited by examiner

*Primary Examiner*—Lee Young
*Assistant Examiner*—Minh Trinh
(74) *Attorney, Agent, or Firm*—Herbert Dubno

(57) ABSTRACT

A method of making high current capacity electrical coil wherein the coil elements are stamped out from a plate or sheet of conductive material with mating male and female formations or mating butt-joints at opposite ends so that the formations of adjacent elements can be fitted together and fusion bonded to form a helix. The latter is coated by powder coating techniques to insulate the coil.

14 Claims, 9 Drawing Sheets

METHOD OF MAKING HIGH-CURRENT COILS

CROSS REFERENCE TO RELATED APPLICATION

Applicants hereby claim the benefit of their provisional application No. 60/095,948 filed Aug. 10, 1998.

FIELD OF THE INVENTION

Our present invention relates to a method of making coils having a high current-carrying capacity and, more particularly, to the production of coils for use in power equipment such as inductors, transformers and the like.

BACKGROUND OF THE INVENTION

It is known to provide coils having a high current-carrying capacity by bending, winding, forming, or similarly shaping a metal alloy, having a high electrical conductivity, e.g. copper or a copper alloy, to produce a round, square, rectangular or other shape helix having a desired internal cross section. As the current-carrying capacity of such a coil, e.g. for use in power equipment such as inductors or transformers, increases, the cross section of each turn must also be increased to the point that bending of the bar becomes increasingly difficult and to the point that problems can arise at each bend. It is desirable, therefore, to provide a system for producing coils of high-current-carrying capacity which will not be limited by the need to bend, wind or form heavy bar stock.

OBJECTS OF THE INVENTION

It is, therefore, the principal object of the present invention to provide an improved method of making a coil, whereby the mentioned drawbacks are obviated.

Another object of the invention is to provide a coil-making method which will yield coils of various current-carrying capacities without limitations resulting from the need to bend bar stock in a particular pattern, or able to produce unsymmetrical cross-sectional area of the copper and to reduce copper loss.

It is still another object of the invention to provide an improved method of making a coil such that the coil will have improved electrical and mechanical properties and enhanced thermal performance.

Still another object of the invention is to provide a coil-making method which is inexpensive to carry out is reproducible and readily repeatable, requires a minimum of skilled labor and machinery and has high versatility as to the configuration and size of the coil to be produced.

SUMMARY OF THE INVENTION

These objects and others which will become apparent hereinafter are attained, in accordance with the invention by stamping preferably angular unit elements from sheet or plate material of high electrical conductivity (usually copper, aluminum or an alloy thereof), while providing, at the ends of the legs of the preferably angular element, respective formations enabling interengagement of such elements to define a helix, interfitting the formations of successive elements to form turns of a helix, and fusing the elements together at these formations.

During the stamping step, the formations, which can include a female formation at one end of each element and a complementary male formation at the other end, can be formed simultaneously with the shaping of the elements. In some cases, however, it may be desirable to first stamp out the element and then provide the male and female formation by an additional stamping or shaping process.

It has been found to be most advantageous to provide the formations as generally T shaped elements with a wide head and a narrow shank. Other formation shapes may, of course, also be used provided they enable interengagement of mating ends of successive angular elements and snug interfitting thereof so that an interconnection practically free from contact resistance is provided between the successive elements, especially when the elements have been subjected to fusion. In a highly advantageous embodiment, the head of the formation has a square shape and the shank an elongated or rectangular shape.

While the angularly adjoining legs will have angles between them which depend upon the polygonal shape of the cross section of the coil, i.e. will be 90° in the case of a rectangular cross section coil or 120° in the case of a hexagonal cross section coil, it is preferred to stamp out the elements so that they have at least two angularly adjoining legs and so that the female formations open laterally on one leg and the male formations project longitudinally from the other leg of, for example, an angular element formed with two legs. The legs of each element can be of equal or different lengths and in a preferred embodiment of the invention, each element is generally L-shaped, but could be U or any other shape.

The fusion according to the invention is preferably a brazing or soldering or welding utilizing a flowable metallic material as a bonding agent. The flowable material may be a brazing composition or a solder and the joints between successive angular elements can be brazed or soldered successively or all at once for the entire coil or in any desired grouping.

More particularly, the method of making the heavy duty electrical coil of the invention can comprise the steps of:

(a) forming a multiplicity of identical elongated electrically conductive elements from at least one plate of electrically conductive material and with each of the elements having a male formation projecting beyond an edge of the respective element at one end and a female formation in the form of a cutout complementary to the male formation and opening at an edge of an opposite end of the respective element;

(b) fitting the male formations of the elements into the female formations of adjoining elements to form respective joints between adjoining elements at which broad surfaces of the adjoining elements are substantially flush with one another, thereby forming a succession of the elements into successive turns of a helix; and (c) fusion bonding each male formation of a respective joint to the adjoining element receiving same, thereby producing the coil.

The elements can be formed, as noted, by stamping them or punching them from plates of the electrically conductive material. Assembly can make use of solder paste, metglass or any other appropriate material in a reflow option and, for example, the entire assembly can be fusion bonded with one dip in a solder pot. The windings can be preassembled on a mandrel for soldering and powdering coating and it is found that with powder coating, turn to turn capacitance can be reduced because of the small turn to turn spacing allowed by the powder coating. The powder coating not only insulates the turns from one another but the turns also from any core which can be provided within the coil.

In structural terms the electrical coil of the invention can thus comprise:

a multiplicity of identical elongated electrically conductive elements stamped from at least one plate of electrically conductive material and with each of the elements having a male formation projecting beyond an edge of the respective element at one end and a female formation in the form of a cutout complementary to the male formation and opening at an edge of an opposite end of the respective element, the male formations of the elements fitting into the female formations of adjoining elements to form respective joints between adjoining elements at which broad surfaces of the adjoining elements are substantially flush with one another, thereby forming successive turns of a helix; and means for fusion bonding each male formation of a respective joint to the adjoining element receiving same, thereby producing the coil.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
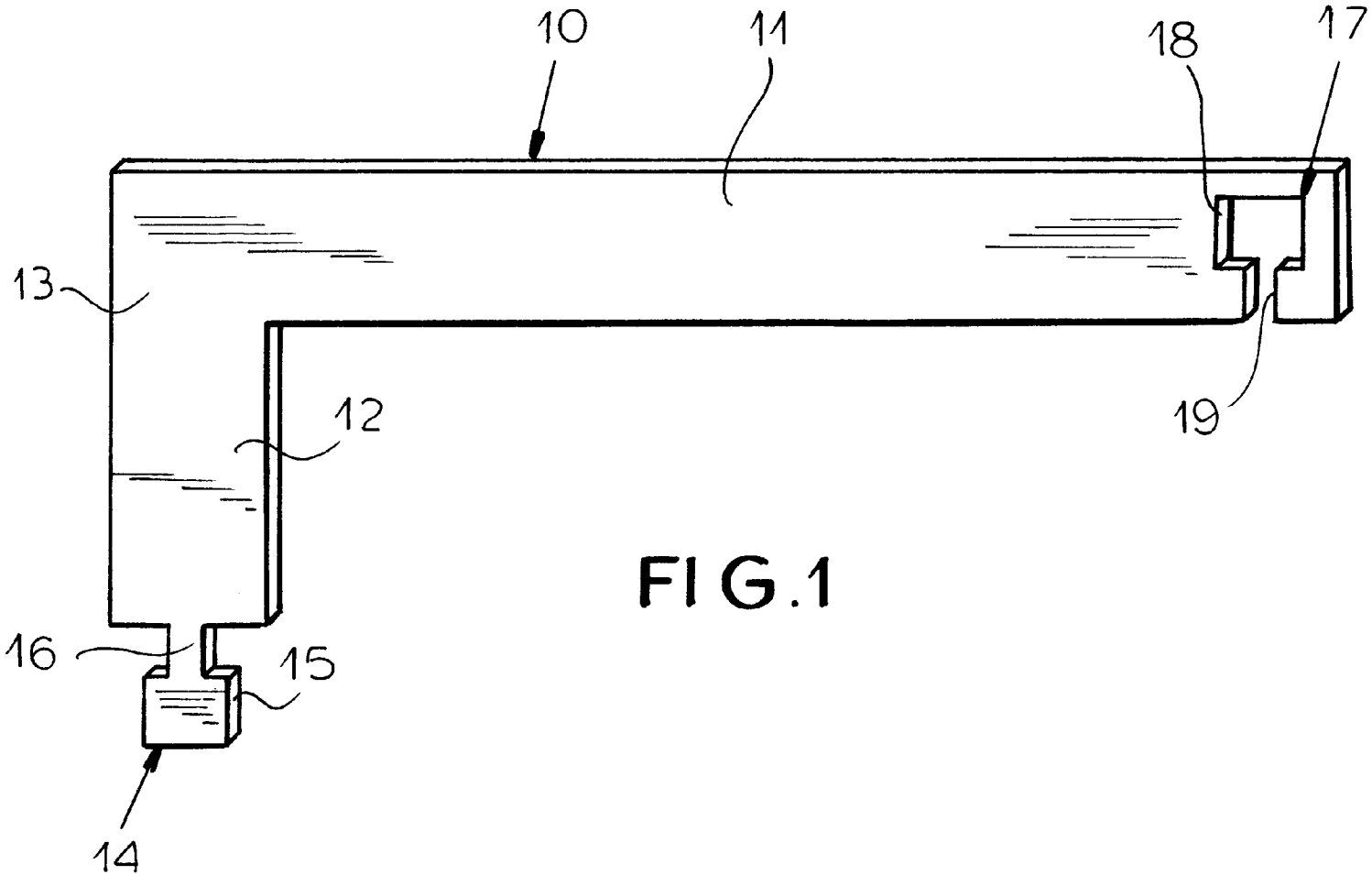
FIG. 1 is a plan view of a coil element according to the invention as stamped out from copper plate or copper sheet.

In FIG. 1 we have shown an angular element which can be used in accordance with the invention for the fabrication of coils. The element comprises an L shaped member 10 having a long leg 11 and a short leg 12 joining one another at an angle 13 which, in this case, is 90°. The short leg 12 is provided with a male formation 14 having a square head 15 and a narrow rectangular shank 16. The male formation is shaped and dimensioned to fit snugly in a female formation 17 of the end of a long leg 11 of another such element. The female formation 17, which is exactly complementary to the male formation to provide a snug fit therewith, comprises a square cutout 18 and a narrow slot 19 opening into this cutout transversely of the long leg 11.

Figure 2:
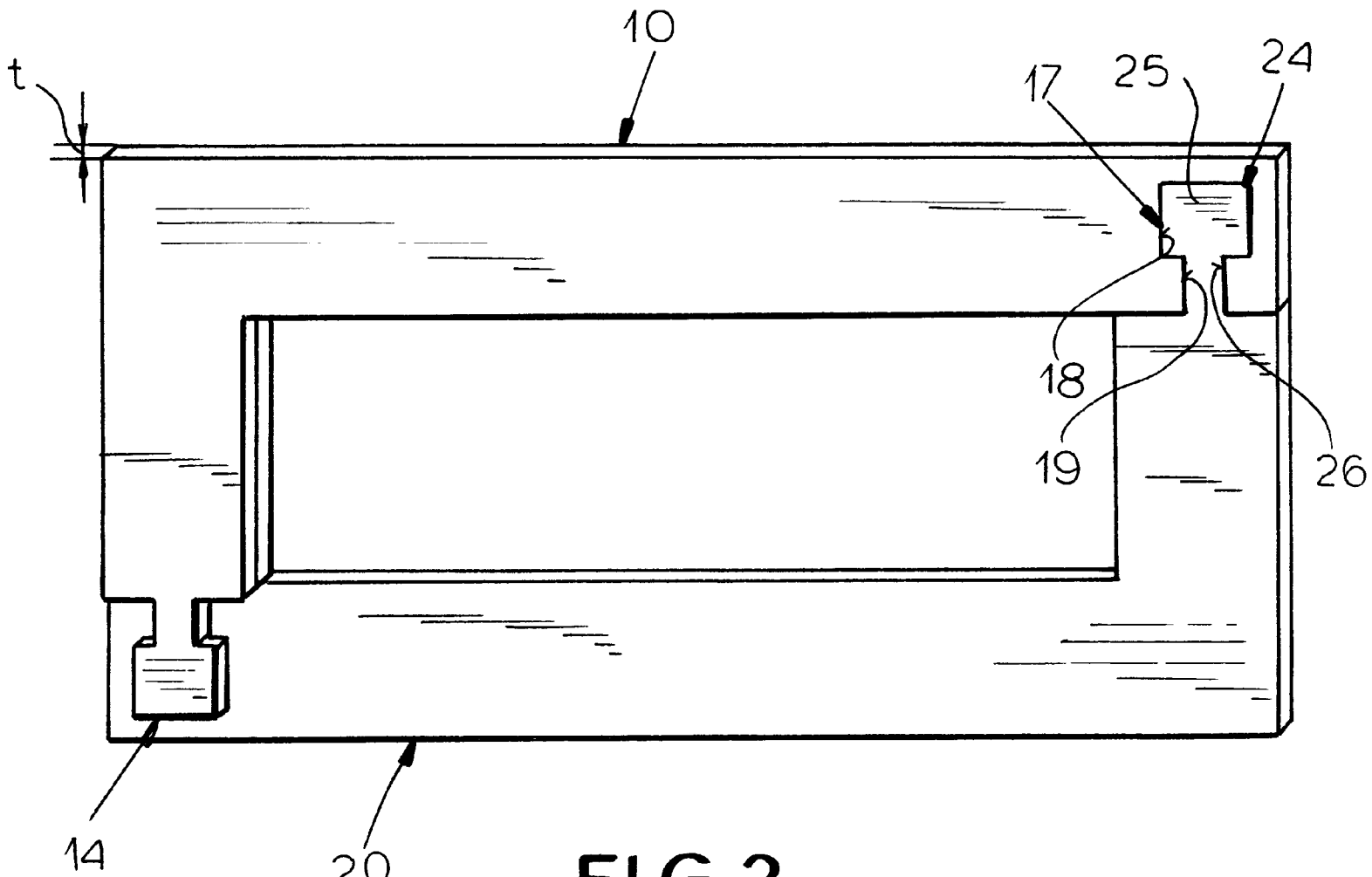
FIG. 2 is an elevational view showing the interfitting of two such elements prior to soldering.
Figure 3:
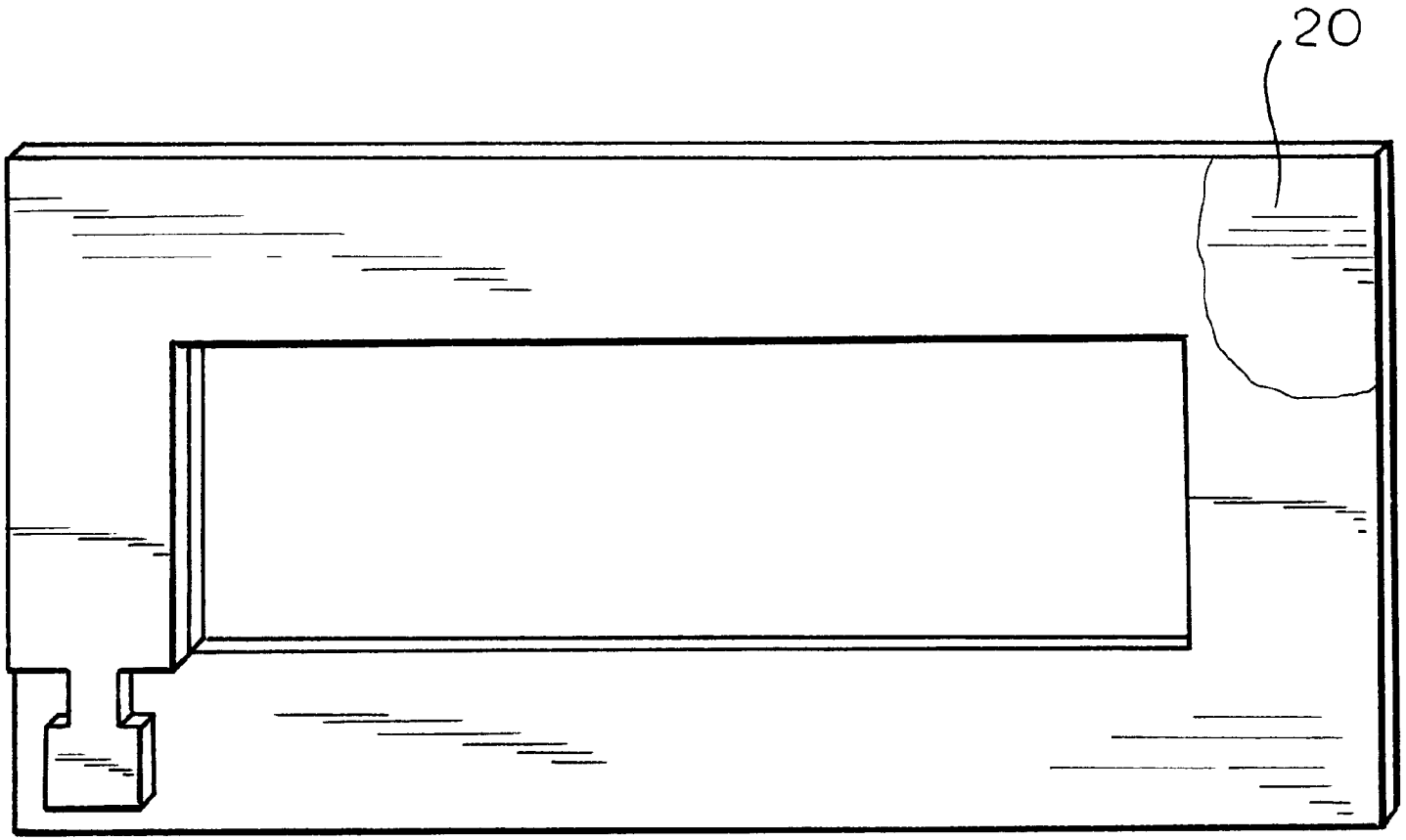
FIG. 3 is a view similar to FIG. 2 showing the joint after soldering.

In FIG. 2, we have shown the element 10 joined to another element 20 of identical shape and, like the element 10, stamped out of copper, a copper alloy or another highly conductive material. The thicknesses t of the elements and the leg cross sections are dimensioned appropriately for the current-carrying capacity of the coil which is to be produced. As can be seen from FIG. 2, moreover, the male formation 24 with its head 25 and its shank 26 are snugly received in the female formation 17 with its square hole 18 and slot 19. The male formation 14, of course, can be received in the female formation of yet another angular element not seen in FIG. 2.

The result is a series of junctions between the angular elements which can be brazed or soldered at 30, the brazing material or soldering material covering the interfitting formation and being drawn by capillarity between the edges of the male and female formations to provide a practically resistance-free junction. The soldering or brazing can be effected by heating of the assembly to the solder flow temperature and contacting the junction with the solder or brazing material by any appropriate means, generally after the application of a flux. When a number of such elements are so connected, they form a helix as shown at 31 in FIG. 4 with successive rectangular turns 32, 33, 34 which can be provided around an air or other core and have a central opening 35 of rectangular configuration. The coil is used for any high-current power application, e.g. as an inductor (choke), reactor or transformer.

The coil can be insulated by winding the turns with tape, by powder coating techniques and any other insulation method suitable to heavy-duty coils and can be potted as is also conventional in the coil-making field. Preferably powder coating is used.

Figure 5:
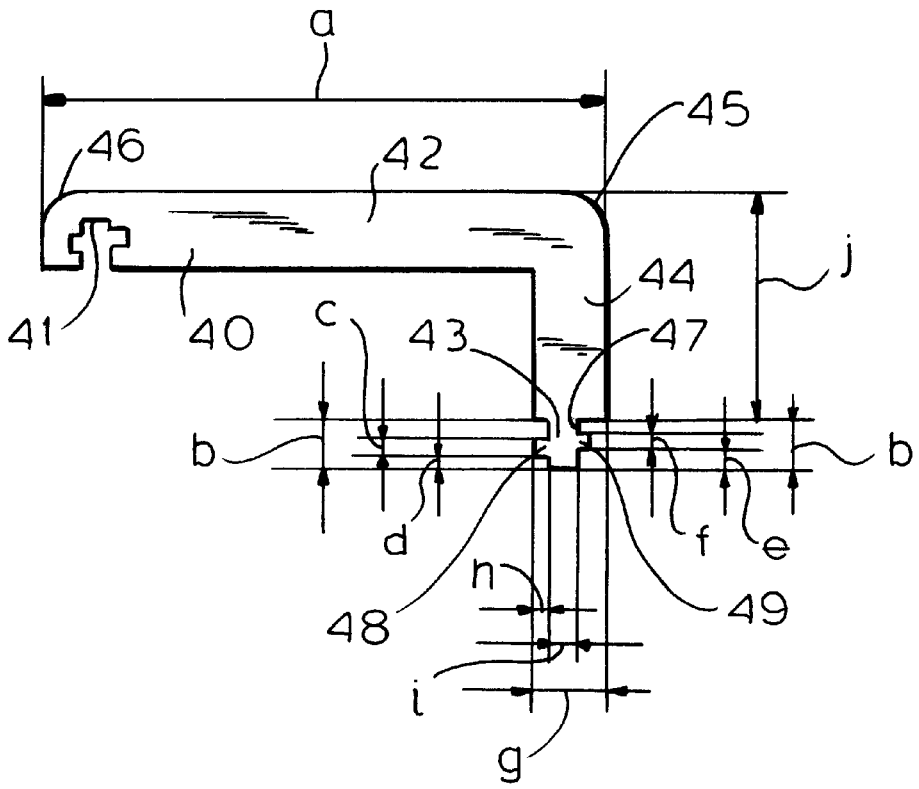
FIG. 5 is a view similar to FIG. 1 of another coil element which can be stamped from copper plate or sheet.

In FIG. 5 we have shown an L-shaped element 40 with a female formation 41 on a long leg 42 and a male formation 43 on a short leg 44. The outer corners of this L-shaped element are rounded at 45 and 46 and the male formation 43, which is complementary to the female formation, may have a shank 47 from which projections 48 and 49, which are offset from one another, may extend here. By way of example, the thickness of the element may be 0.125", the length a of the long arm may be 4.885", the length of the short arm may be 2.030" as shown at j and the dimensions b through i of the various parts of the formation may be:

b=0.400"
c=0.150"
d=0.080"
e=0.150"
f=0.150"
g=0.670"
h=0.150"
i=0.231", all with tolerances of ±0.005".

Figure 4:
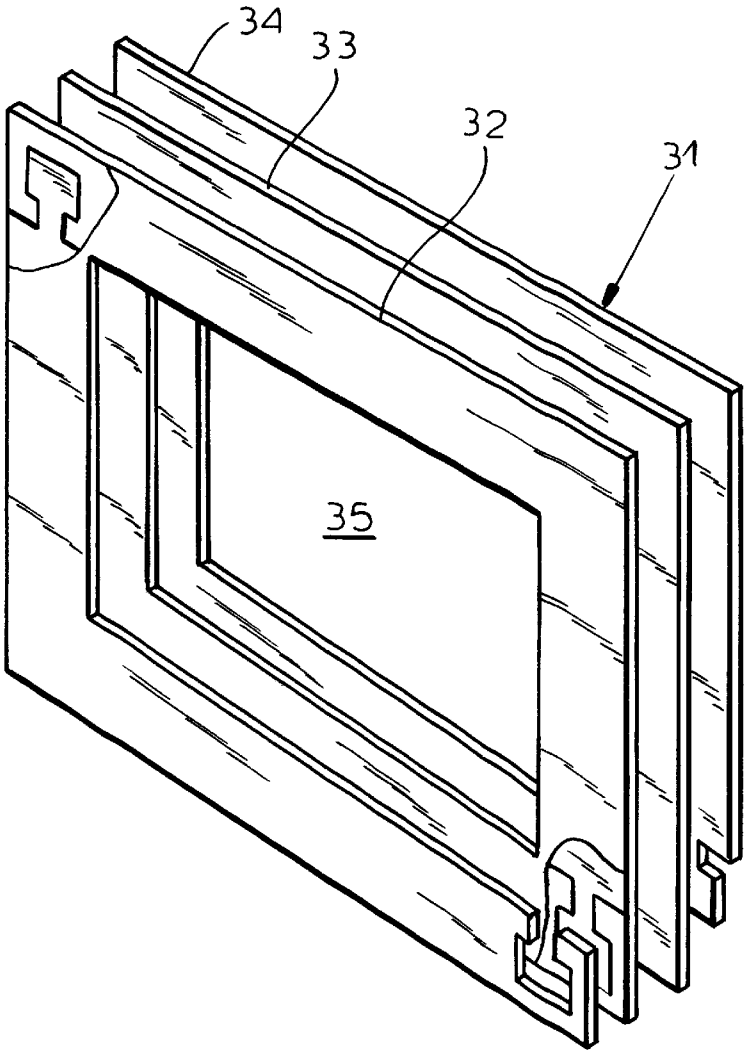
FIG. 4 is a perspective view of a portion of a coil according to the invention.
Figure 6:
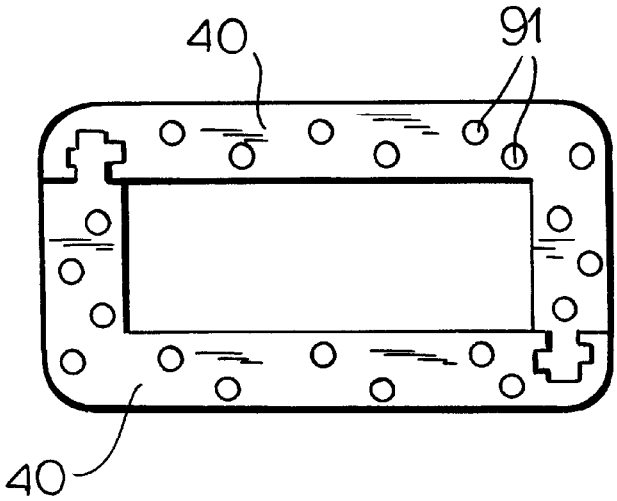
FIG. 6 is a view showing the interfitting of two such elements.

The elements 40 may be interfitted as shown in FIG. 6 to form the helix of rectangular cross section as has been described in connection with FIG. 4 with fusion bonding of the joints formed by fitting the male formations into the female formations.

Figure 7:
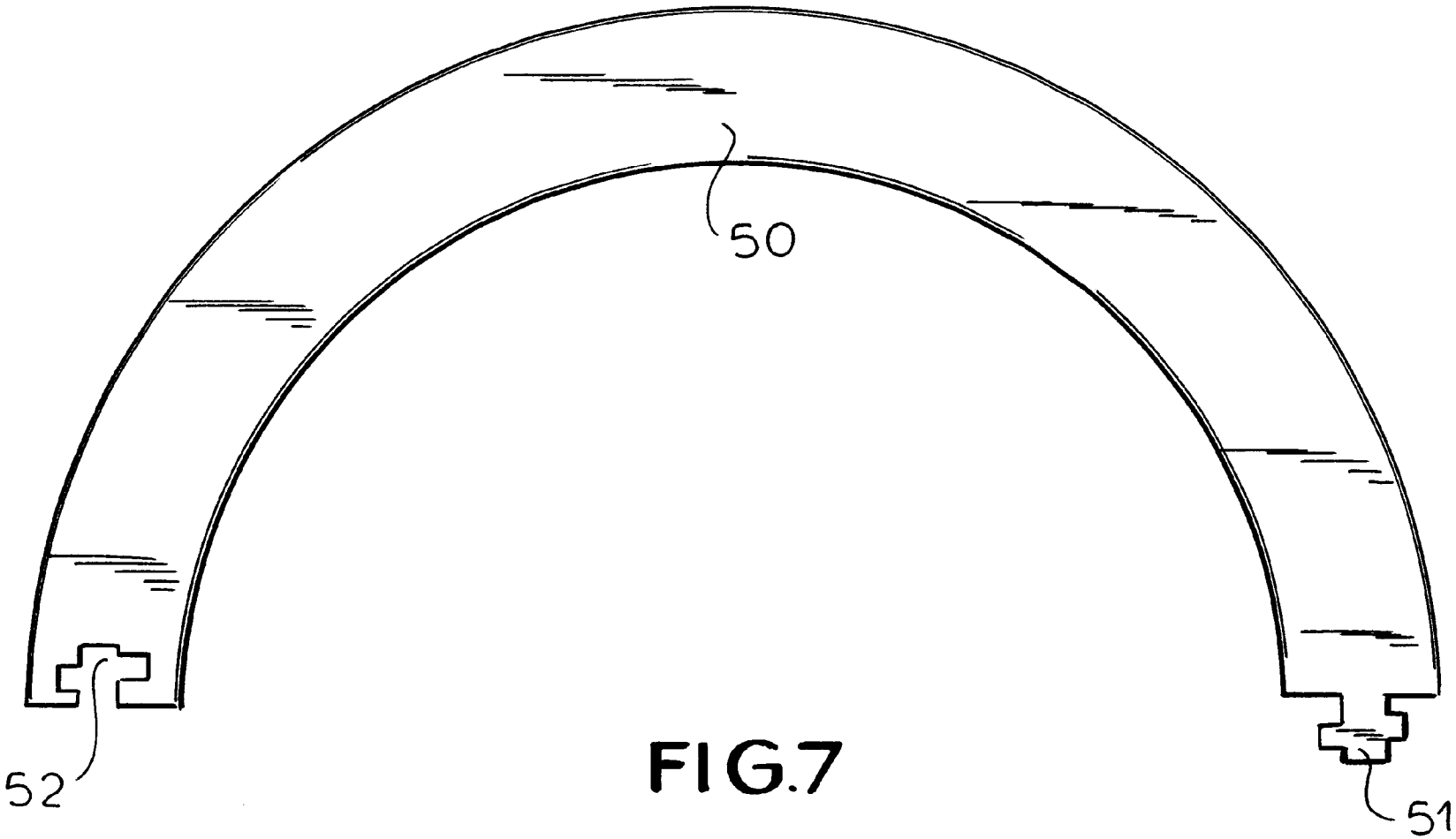
FIG. 7 is a view similar to FIG. 1 of an arcuate element.
Figure 8:
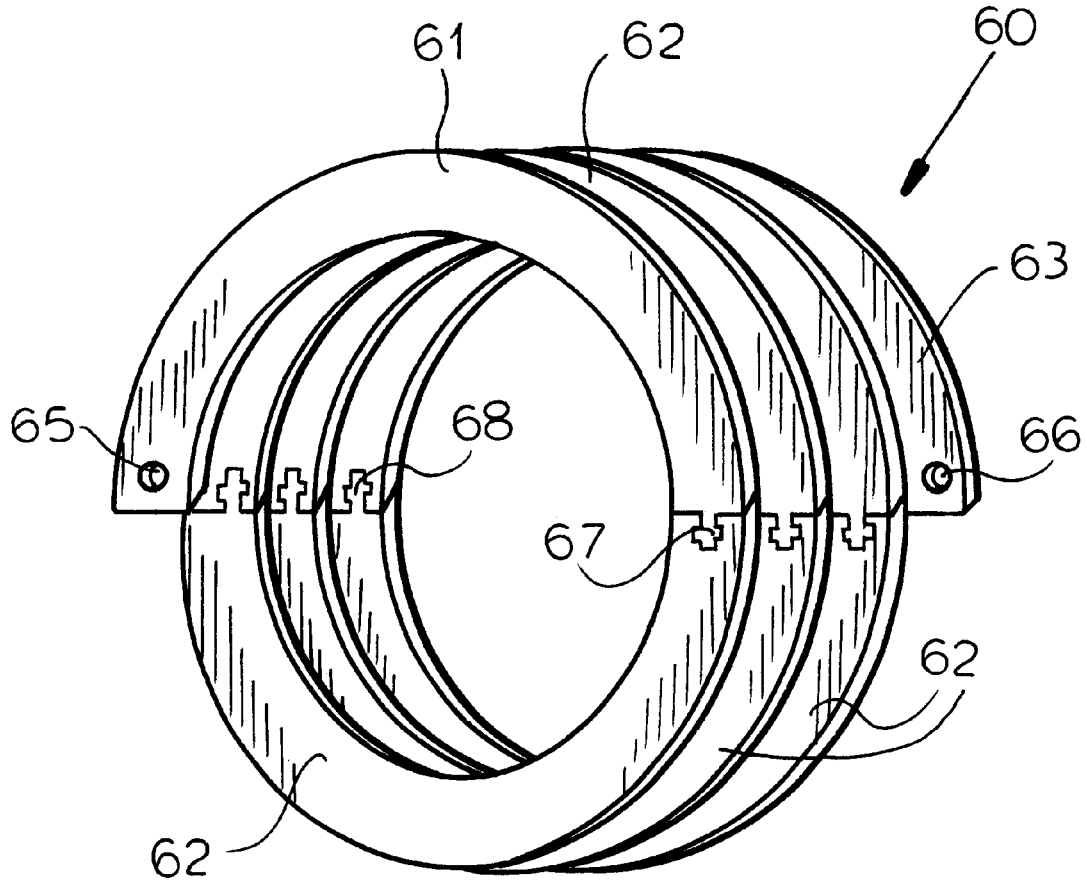
FIG. 8 is a perspective view of a circular coil made with elements similar to those of FIG. 7.
Figure 9:
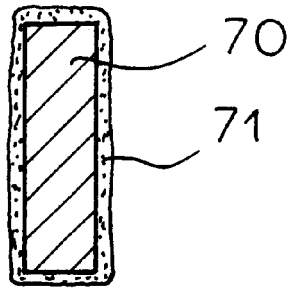
FIG. 9 is a cross section through a turn of one of the helices of the invention showing the powder coating insulation applied thereto.

As can be seen from FIG. 7, while an angular configuration of the element is desirable it is not essential and the element 50 can be arcuate and generally semicircular with a male formation 51 and a female formation or recess 52 at the opposite ends thereof, these formations having the offset configuration described in connection with FIGS. 5 and 6. FIG. 8 shows a helical coil 60 of circular configuration, made up of element 61, 62 and 63 of arcuate configuration, the element 62 having male and female formations at opposite ends generally as described in connection with FIG. 7 but with formations more closely resembling those of FIGS. 1–4. The terminal sections 61 and 63 can have studs or holes to receive studs as shown at 65 and 66 and may have male formations 67 or female formations 68 at opposite ends to complete the coil. The members 65 and 66 serve to provide the electrical connections to the coil. As has been shown in FIG. 9, the conductive member 70, i.e. the elements forming the helix in all of the embodiments described may be powder coated with electrical insulation at 71 so that successive turns of the helix can be located close together.

Figure 10:
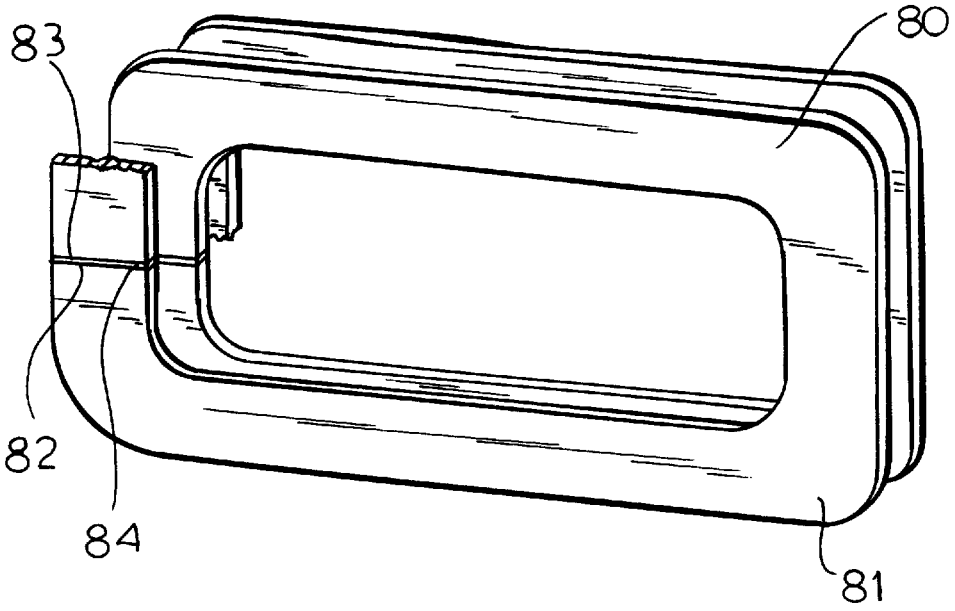
FIG. 10 is a perspective view illustrating another method of connecting the turns.

We have also found that it is possible to connect the halves of the turns together by butt joints utilizing, for example, an amorphous conductive material in or on the side of the butt joint to join the two ends together. This is shown in FIG. 10 wherein the two halves 80 and 81 of each of the turns have butt ends 82, 83 which are joined together at 84 by solder or brazing material if desired or simply by a fusion weld.

Figure 11:
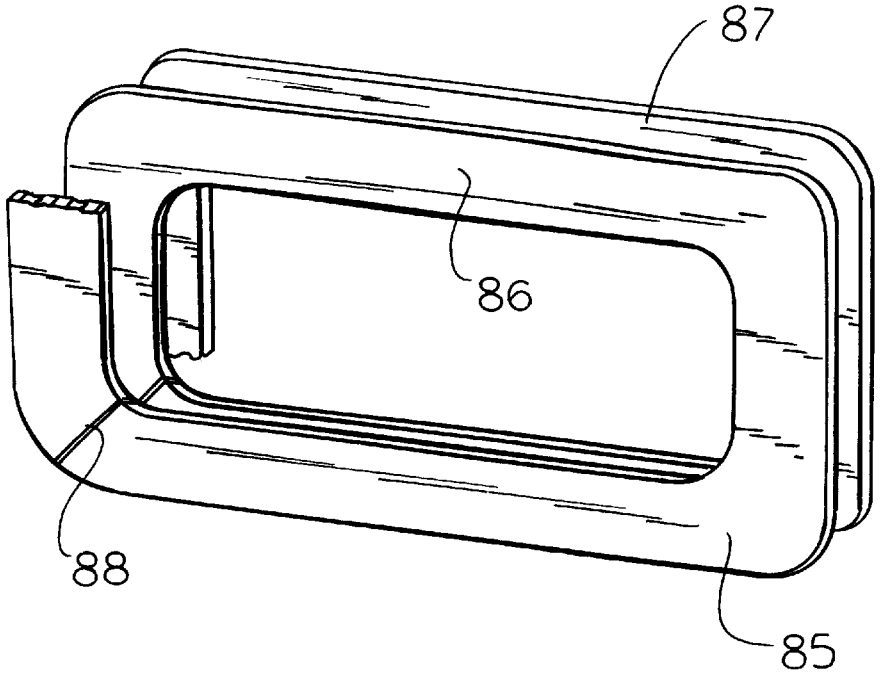
FIG. 11 is a view similar to FIG. 10 of another modification.

It is possible, in addition, to make the turns in one piece and to interconnect the turns by butt joints. That has been shown in FIG. 11 wherein each turn 85, 86, 87 is formed as a single stamping and the cut ends of the turns are joined together at 88 by butt joints in the manner which has been described in connection with FIG. 10. The butt joints can be across a leg of the winding or dimensional at the bends thereof (compare FIGS. 10 and 11).

An important characteristic of the invention is our ability to provide asymmetrical windings to reduce coil resistance.

Figure 12:
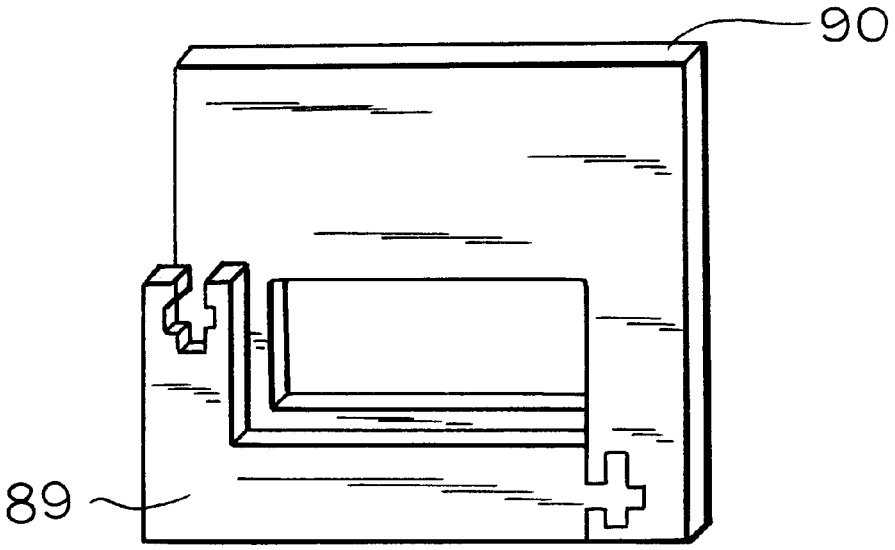
FIG. 12 is a perspective view of a portion of a coil showing asymmetrical turns.
Figure 13:
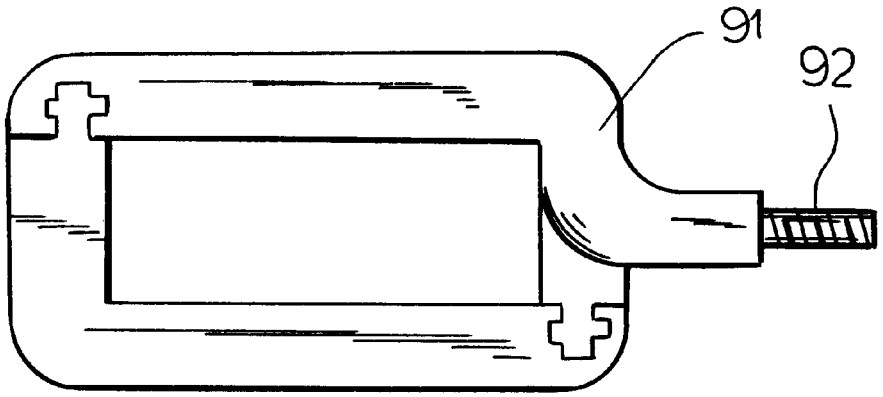
FIG. 13 is an end view of a coil showing one of the terminals.

This is not possible with conventional coil formation techniques. The inner dimension of each turn can be limited by core geometry but the external dimension can be as large as desired. Further, the external dimension can be made smaller than the cross section of the window to suit a particular external physical constraint. This has been represented in FIG. 12 where each turn is formed from a narrow segment 89 and a side segment 90 interconnected at their ends in the manner which has been described in connection with FIGS. 1 through 9.

As can be seen from FIG. 6, we can reduce eddy currents in any of the windings produced in accordance with the invention by forming holes 91 through the stampings. The holes reduce the currents induced by the magnetic field in adjacent turns. While this may increase the DC resistance of the turn, it can lower overall power dissipation because of the decrease in AC resistance and induced eddy currents. Since the losses are dependent upon the current wave form, this will dictate the size and number of holes if any.

Finally, we note that terminations are cumbersome in conventional coils and the formation of them is labor intensive and time consuming. A bus bar, for example, may have to be soldered to the copper foil to extend out of the coil area. In the present invention, the termination may be an extra turn or partial turn as represented at 91 that leads out of the coil area and has a stud or other connecting device as shown at 92 attached to it. No difficult manual labor or special techniques are required and the stud can take a high degree of torque and can have low termination resistance.

We claim:

1. A method of making a heavy duty electrical coil comprising the steps of:

(a) forming a multiplicity of identical elongated electrically conductive elements from at least one plate of electrically conductive material and with each of said elements having a male formation projecting beyond an edge of the respective element at one end and a female formation in the form of a cutout complementary to said male formation and opening at an edge of an opposite end of the respective element;

(b) fitting the male formations of said elements into the female formations of adjoining elements to form respective joints between adjoining elements at which broad surfaces of said adjoining elements are substantially flush with one another;

(c) joining a multiplicity of said elements together on a support into successive spaced turns of a helix; and (d) while said elements form said helix on said support, fusion bonding each male formation of a respective joint to the female formation of the adjoining element receiving same, thereby producing said coil.

2. The method defined in claim 1 wherein said elements are formed by stamping said elements from plates of said material.

3. The method defined in claim 2 wherein said joints are fusion bonded by welding.

4. The method defined in claim 2 wherein said joints are fusion bonded by dip soldering.

5. The method defined in claim 2 wherein said joints are fusion bonded by brazing.

6. The method defined in claim 1, further comprising the step of insulating said turns.

7. The method defined in claim 6 wherein said turns are insulated by powder coating.

8. The method defined in claim 6 wherein said turns are insulated by wrapping them with an insulating material.

9. The method defined in claim 1 wherein said elements are stamped out in a generally L-shape with angularly adjoining legs and said helix has a generally polygonal cross section.

10. A method of making a heavy duty electrical coil comprising the steps of:

(a) forming a multiplicity of identical elongated electrically conductive coil elements and at least two terminal elements having means for attaching conductors thereto from at least one plate of electrically conductive material and with each of said coil elements having a male formation projecting beyond an edge of the respective element at one end and a female formation in the form of a cutout complementary to said male formation and opening at an edge of an opposite end of the respective element, and said terminal elements having formations complementary to the formations of respective coil elements for attachment thereto;

(b) fitting the male formations of said elements into the female formations of adjoining elements to form respective joints between adjoining elements at which broad surfaces of said adjoining elements are substantially flush with one another;

(c) joining said elements together on a support into a helix having said terminal elements at ends of said helix, thereby forming a succession of said elements into successive spaced turns of the helix;

(d) fusion bonding each male formation of a respective joint to the adjoining element receiving same, by dipping the helix on said support into solder, thereby producing said coil; and (e) thereafter insulating said turns.

11. The method defined in claim 10 wherein said elements are formed by stamping said elements from plates of said material.

12. The method defined in claim 11 wherein said turns are insulated by powder coating.

13. The method defined in claim 12 wherein said turns are insulated by wrapping them with an insulating material.

14. The method defined in claim 13 wherein said elements are stamped out in a generally L-shape with angularly adjoining legs and said helix has a generally polygonal cross section.

* * * * *